US006361106B1

(12) United States Patent
Huang

(10) Patent No.: US 6,361,106 B1
(45) Date of Patent: Mar. 26, 2002

(54) FOLDING COLLAPSIBLE FRAME STRUCTURE FOR A BABY ROCKING CHAIR

(76) Inventor: Mien Chen Huang, 123-2, Pitou, Kuanmiao, Tainan (TW)

( * ) Notice: Subject to any disclaimer, the term of this patent is extended or adjusted under 35 U.S.C. 154(b) by 0 days.

(21) Appl. No.: 09/614,479

(22) Filed: Jul. 11, 2000

(51) Int. Cl.[7] ..... A47C 3/02
(52) U.S. Cl. ..... 297/32; 297/16.1; 297/258.1
(58) Field of Search ..... 297/32, 33, 258.1, 297/260.3, 270, 20, 55, 16.1, 377; 403/102

(56) References Cited

U.S. PATENT DOCUMENTS 5,172,955 A * 12/1992 Freese et al. ..... 297/328 X
5,207,478 A * 5/1993 Freese et al. ..... 297/16.1 X
5,253,921 A * 10/1993 Boulet ..... 297/32
5,269,591 A * 12/1993 Miga, Jr. et al. ..... 297/16.1 X
5,503,458 A * 4/1996 Petrie ..... 297/16.1 X
5,868,459 A * 2/1999 Welsh, Jr. ..... 297/32

* cited by examiner

*Primary Examiner*—Jose V. Chen
*Assistant Examiner*—Stephen Vu
(74) *Attorney, Agent, or Firm*—Pro-Techtor International Services

(57) ABSTRACT

A folding collapsible frame structure for baby rocking chair includes a base frame having two rockers at two opposite lateral sides, two side bars upwardly backwardly extended from the rockers of the base frame, a back frame tube, the back frame tube having two distal ends respectively pivoted to the side bars above the base frame, a seat frame pivoted to the two distal ends of the back frame tube, two front links bilaterally coupled between the side bars and the seat frame, two rear links bilaterally coupled between the rockers of the base frame and the two distal ends of the back frame tube, and two locks installed in the two distal ends of the back frame unit and the top end of the side bars, the locks being locked to stop the back frame tube from being turned relative to the side bars, or unlocked for enabling the back frame tube to be turned forwards and then downwards to a collapsed condition.

3 Claims, 8 Drawing Sheets

FOLDING COLLAPSIBLE FRAME STRUCTURE FOR A BABY ROCKING CHAIR

BACKGROUND OF THE INVENTION

The present invention relates to a baby rocking chair, and more specifically to a frame structure for a baby rocking chair, which is folding collapsible.

A variety of baby chairs and beds have been disclosed, and have appeared on the market. FIGS. 1 and 2 show two different baby chairs according to the prior art. These two baby chairs commonly comprise a base frame 10, a seat 30 suspended above the base frame 10, and spring members 20 bilaterally connected between the base frame 10 and the seat 30. Because of the effect of the spring members 20, the seat 30 is oscillated up and down when the baby sits or lies on the seat 30. These prior art baby chairs are still not satisfactory in function. Because these prior art baby chairs are not collapsible, they occupy much storage space when not in use. Further, the seat 30 cannot be adjusted between different angles to support the baby between different positions (sitting or lying position).

SUMMARY OF THE INVENTION

The invention has been accomplished under the circumstances in view. It is one object of the present invention to provide a frame structure for a baby rocking chair, which is folding collapsible. It is another object of the present invention to provide a frame structure for a baby rocking chair, which can be conveniently adjusted to change the tilting angle of the seat. According to one aspect of the present invention, the folding collapsible frame structure comprises a base frame having two rockers at two opposite lateral sides, two sidebars upwardly backwardly extended from the rockers of the base frame, a back frame tube, the back frame tube having two distal ends respectively pivoted to the sidebars above the base frame, a seat frame pivoted to the two distal ends of the back frame tube, two front links bilaterally coupled between the sidebars and the seat frame, two rear links bilaterally coupled between the rockers of the base frame and the two distal ends of the back frame tube, and two locks installed in the two distal ends of the back frame unit and the top end of the sidebars, the locks being locked to stop the back frame tube from being turned relative to the sidebars, or unlocked for enabling the back frame tube to be turned forwards and then downwards to a collapsed condition. According to another aspect of the present invention, footrests are bilaterally provided at the front side of the base frame for the rest of the feet. According to still another aspect of the present invention, a canopy and a toy rack are respectively provided at the back frame tube and the sidebars.

DETAILED DESCRIPTION OF THE PREFERRED EMBODIMENT

Figure 1:
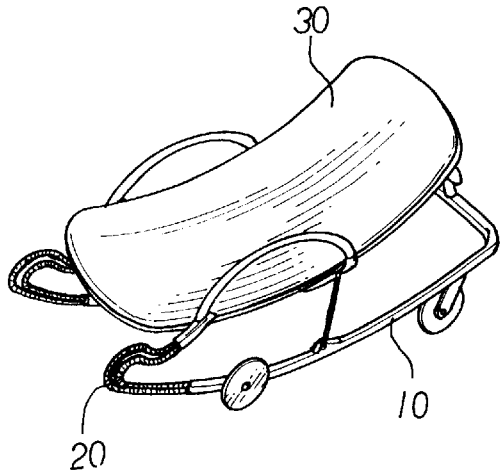
( Prior Art ) FIG. 1
FIG. 1 is a perspective view of a baby chair according to the prior art.
Figure 2:
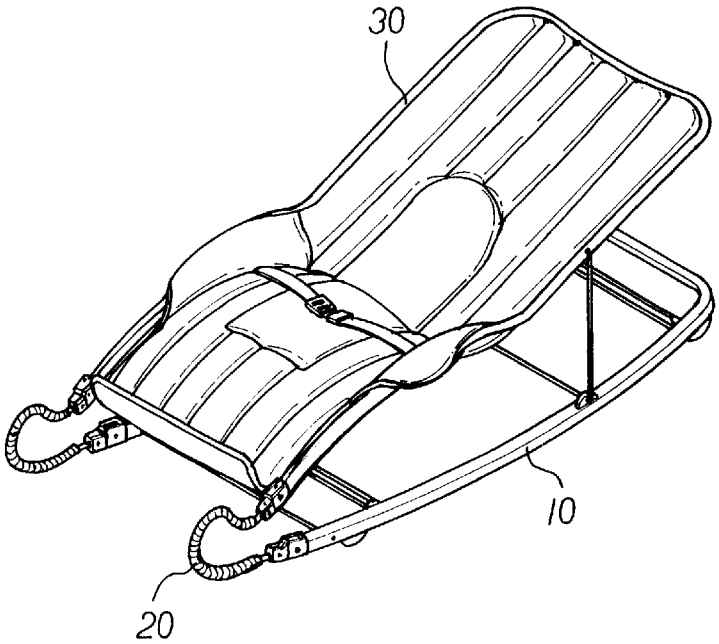
( Prior Art ) FIG. 2
FIG. 2 is a perspective view of another structure of baby chair according to the prior art.
Figure 3:
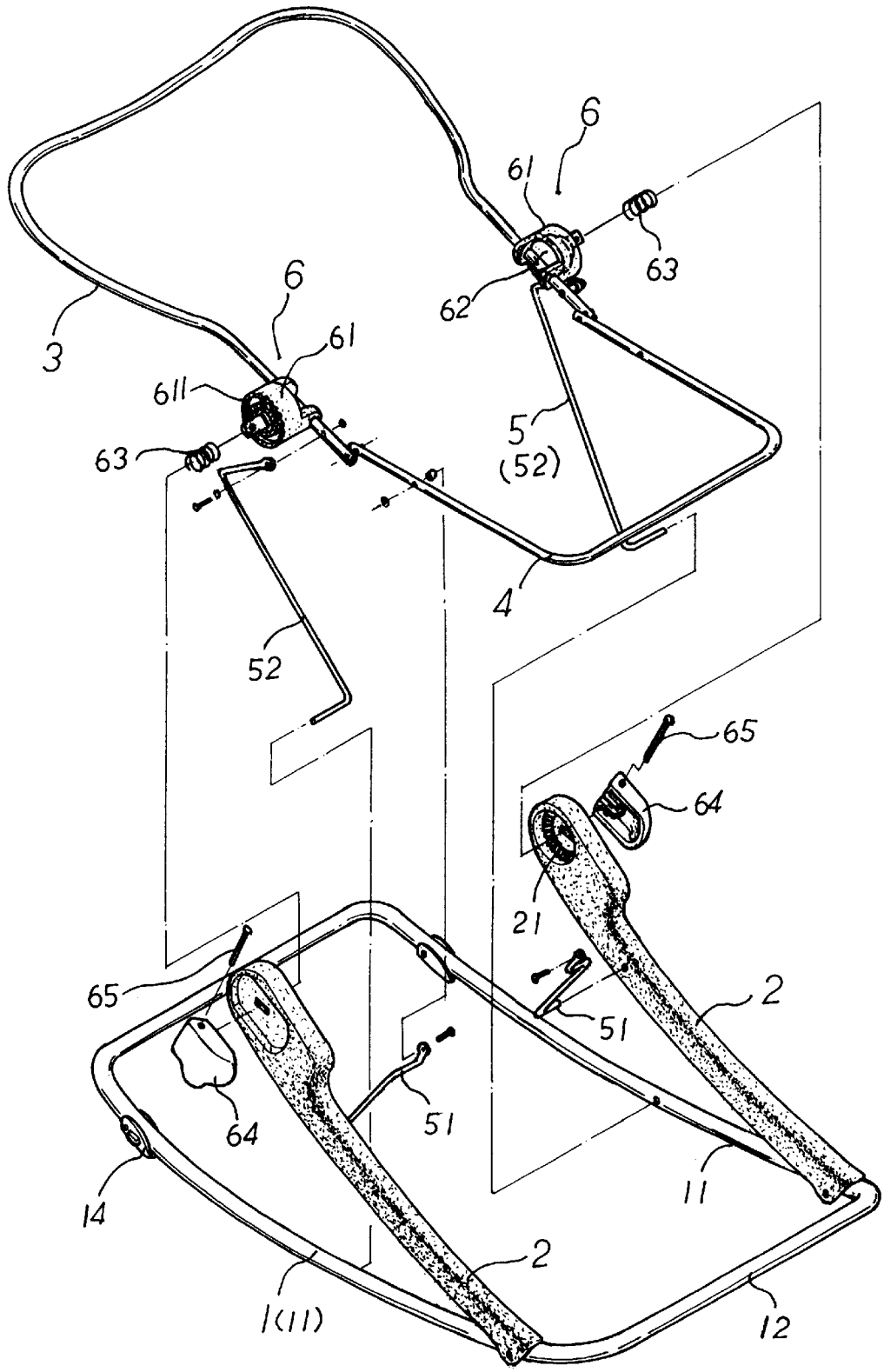
FIG. 3 is an exploded view of a frame structure for a baby rocking chair according to the present invention.
Figure 4:
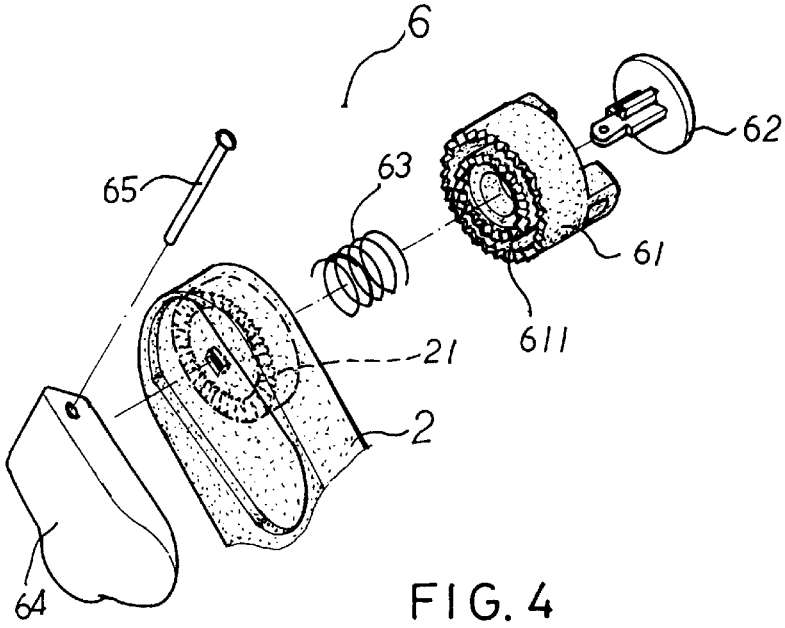
FIG. 4 is an exploded view of a lock for the frame structure shown in FIG. 3.
Figure 5:
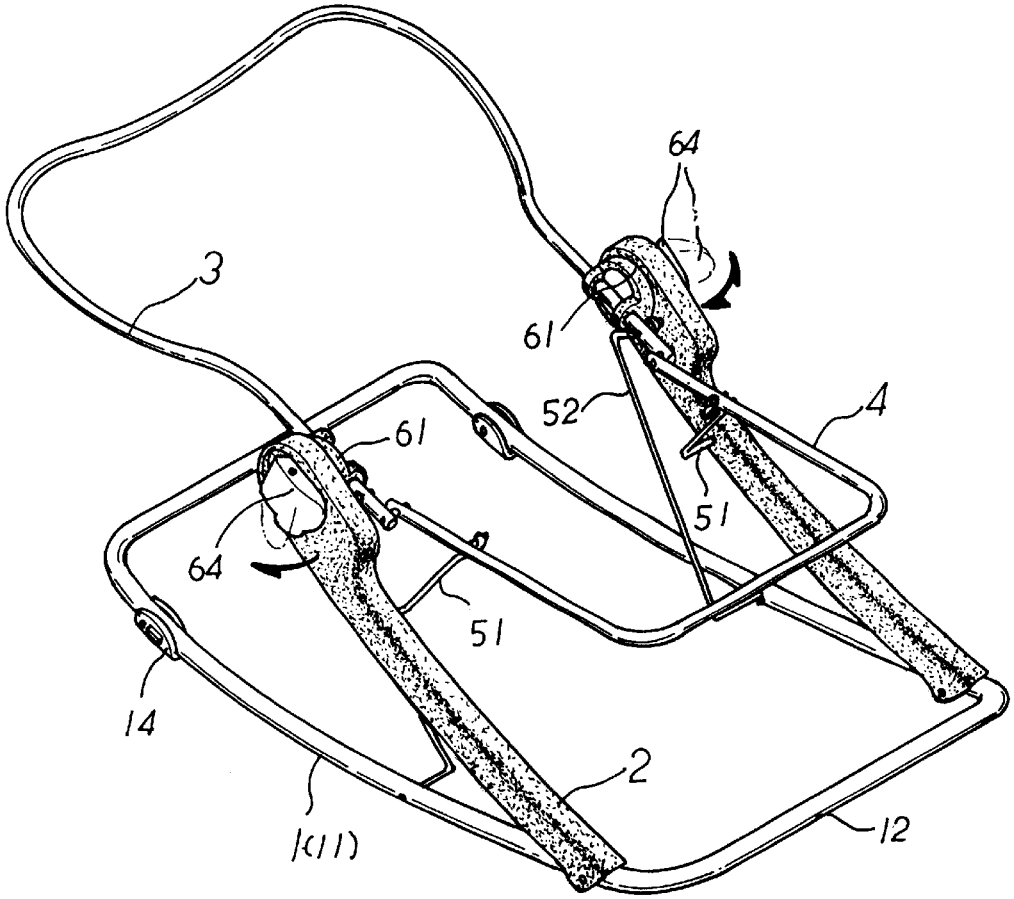
FIG. 5 is an assembly view of the frame structure shown in FIG. 3.

Referring to FIGS. 3 and 5, a frame structure for a baby rocking chair in accordance with the present invention is generally comprised of a base frame 1, two sidebars 2, a back frame tube 3, a seat frame tube 4, and a link unit 5.

Figure 6:
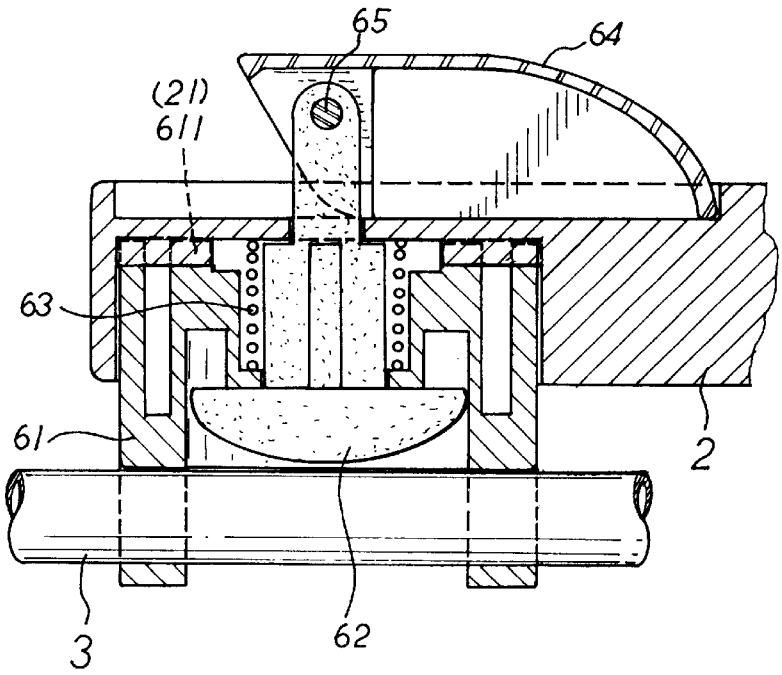
FIG. 6 is an enlarged view of a part of the present invention, showing the lock locked.
Figure 7:
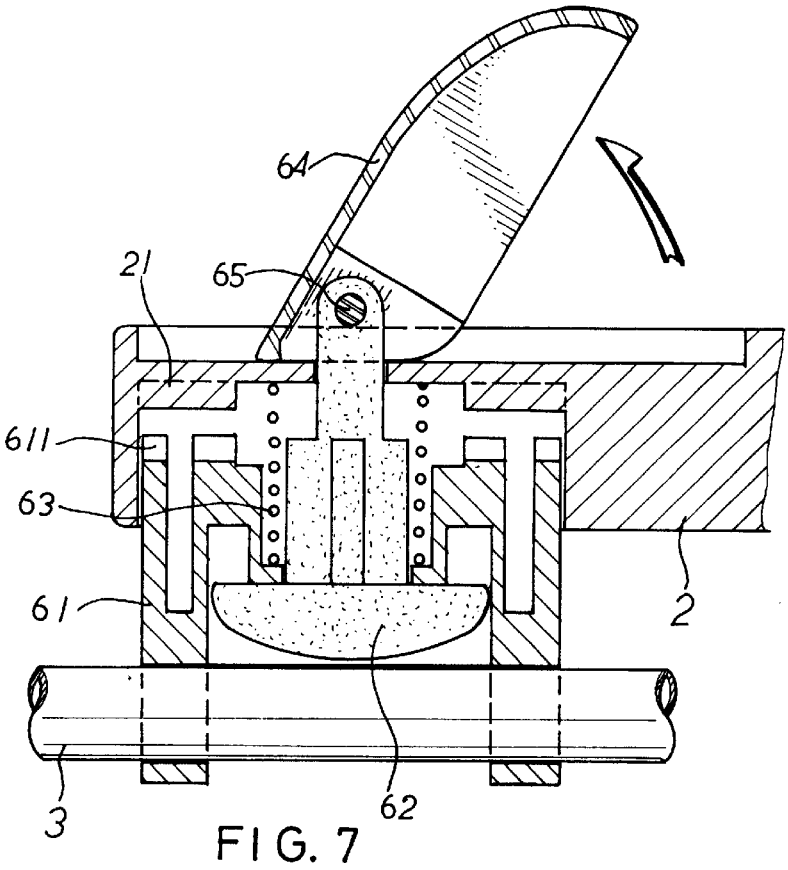
FIG. 7 is an enlarged view of a part of the present invention, showing the lock unlocked.
Figure 8:
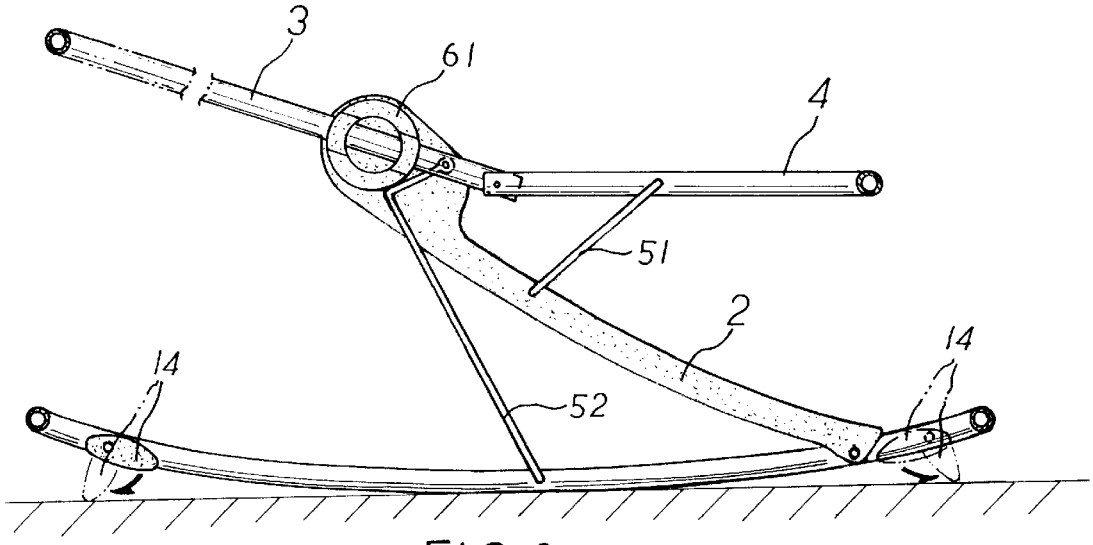
FIG. 8 is a side view of the present invention showing the stand means turned between the operative position and the non-operative position.
Figure 9:
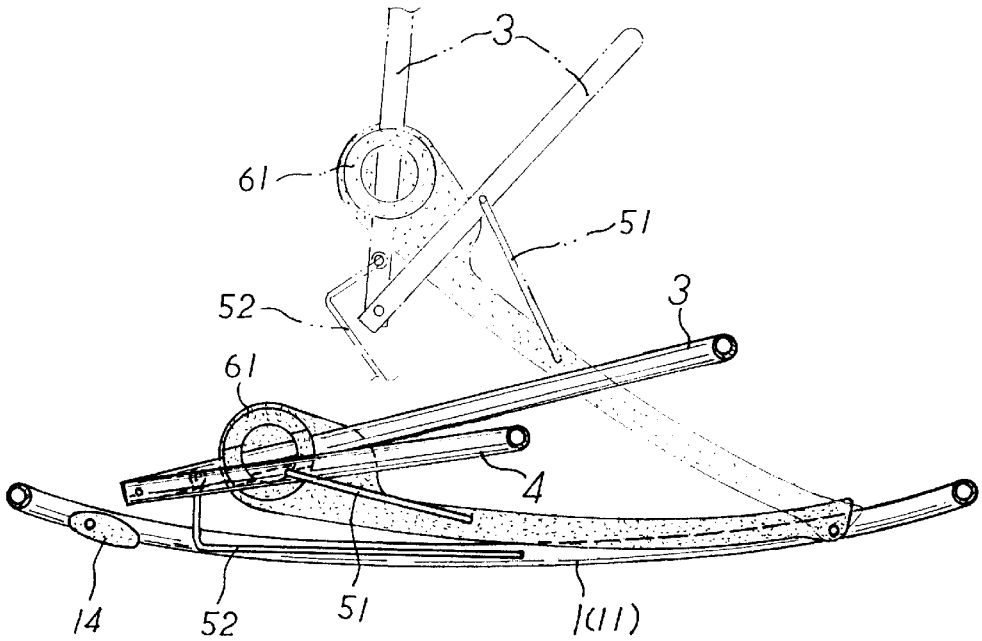
FIG. 9 is a schematic drawing showing the collapsing procedure of the frame structure according to the present invention.
Figure 10:
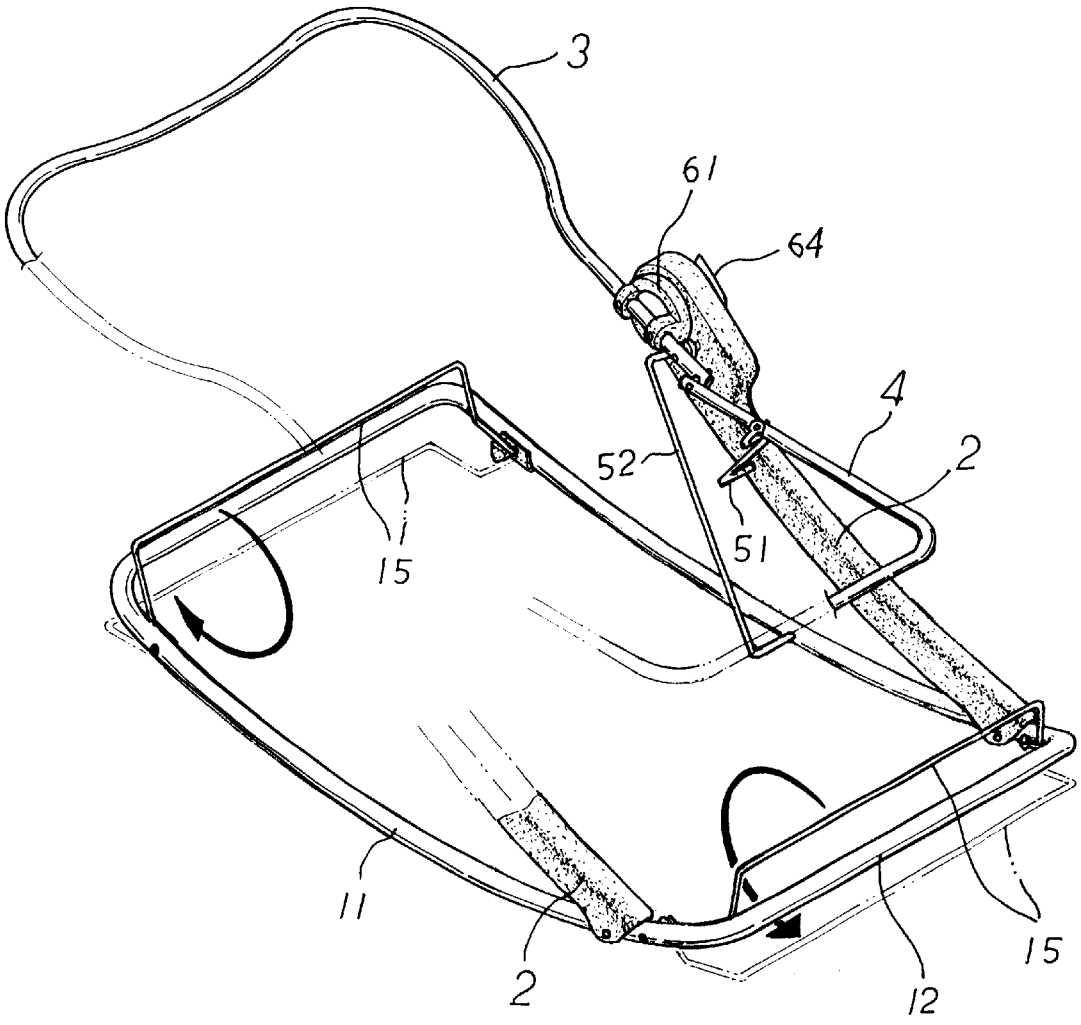
FIG. 10 is a schematic drawing showing the operation of an alternate form of the stand means according to the present invention.

The base frame 1 is a substantially rectangular open frame comprising two rockers 11 arranged in parallel at two opposite lateral sides, and a transverse front tube 12 connected between the rockers 11 at a front side. In the embodiment shown in FIG. 3, the transverse front tube 12 has two distal ends respectively integral with the front end of the rockers 11. In the embodiment shown in FIG. 11, the transverse front tube 12 is an independent tube having two angled ends respectively fastened to the rockers 11. Stand means 14 or 15 is provided at the rear side (see FIGS. 3, 4, 9 and 11) or both the front and rear sides (see FIGS. 8 and 10) of the base frame 1, and turned between the operative position where the stand means 14 or 15 stops the baby rocking chair from rocking, and the non-operative position where the baby rocking chair is allowed to rock. Footrests 16 are provided at the front side of the base frame 1 for the rest of the feet (see FIG. 11). In the embodiment shown in FIG. 11, the rockers 11 are covered with a respective flexible covering 13. The sidebars 2 are obliquely extended from the base frame 1, each having a bottom end fixedly connected to one rocker 11 of the base frame 1, and a top end connected one end of the back frame tube 3 by a lock 6. The lock 6, as shown in FIGS. from 3 through 7, comprises a casing 61, a shaft 62, a spring 63, a locking lever 64, and a pivot pin 65. The casing 61 is fixedly fastened to one end of the back frame tube 3, comprising a ratchet 611 at one side thereof adapted for engaging a ratchet 21 one sidebar 2. The shaft 62 is a headed member inserted through the center through hole of the casing 61 and a through hole through the center of the ratchet 21 of the corresponding sidebar 2 with its head stopped at one side of the casing 61 opposite to the ratchet 611. The spring 63 is mounted on the shaft 62 and connected between the corresponding sidebar 2 and the casing 61 to force the casing 61 outwards from the corresponding sidebar 2. The locking lever 64 is pivoted to the distal end of the shaft 62 by the pivot pin 65, and turned between the locking position where the ratchet 611 of the casing 61 is kept in engagement with the ratchet 21 of the corresponding sidebar 2 and the back frame tube 3 is stopped from movement relative to the sidebars 2 (see FIGS. 6 and 8), and the unlocking position where the casing 61 is forced outwards from the corresponding sidebar 2 by the spring 63 and the back frame tube 3 is allowed to be turned about the shaft 62 to the desired angle relative to the sidebars 2 (see FIGS. 7 and 9).

Figure 11:
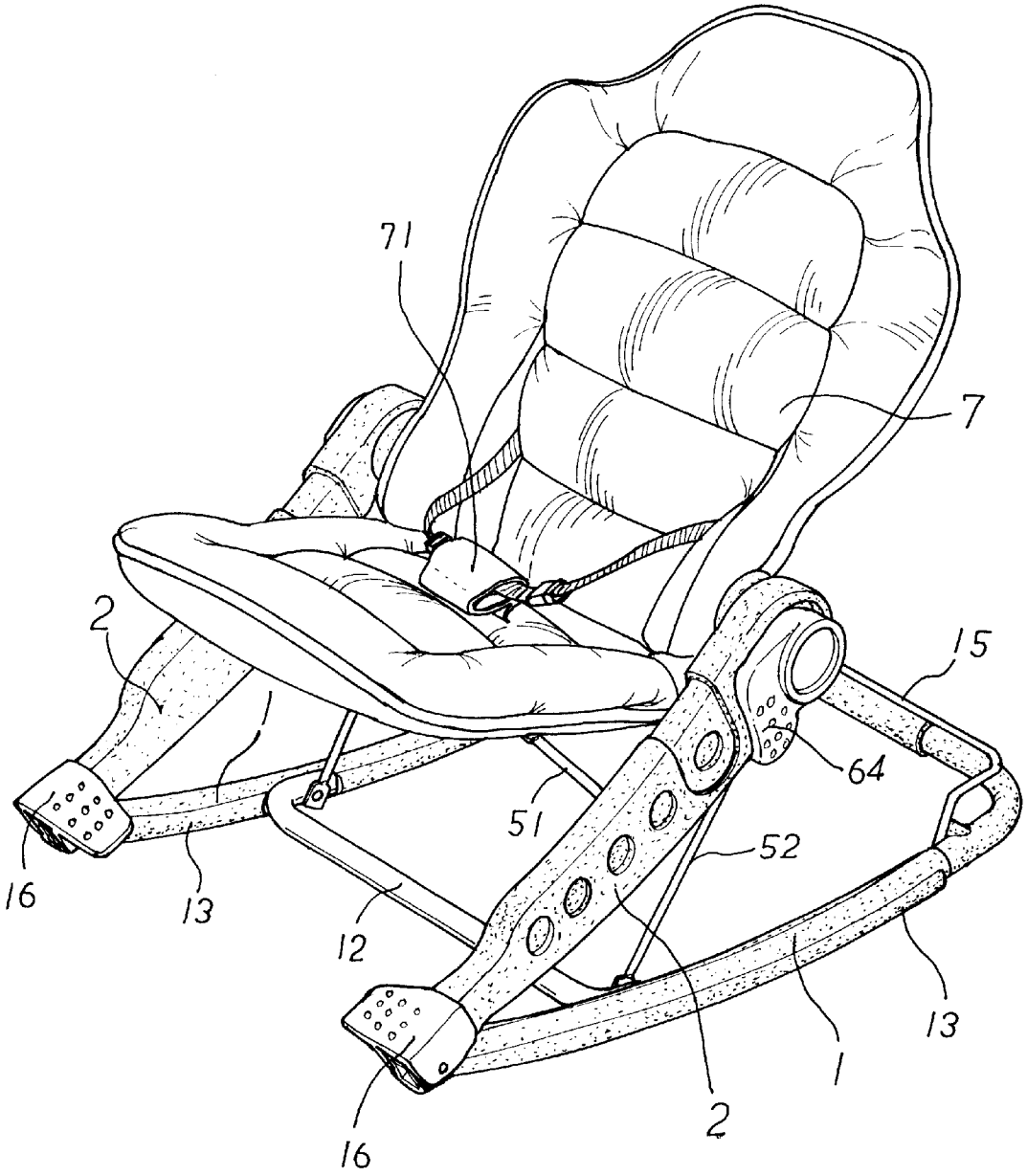
FIG. 11 is a perspective view of a baby rocking chair constructed according to the present invention.

The seat frame tube 4 is a substantially U-shaped tube adapted to hold a padded seat 7, having two distal ends respectively pivoted to the two distal ends of the back frame tube 3 (see FIG. 11).

The link unit 5 comprises two front links 51 bilaterally coupled between the seat frame tube 4 and the sidebars 2, and two rear links 52 bilaterally coupled between the rockers 11 of the base frame 1 and the back frame tube 3.

When in use, the locks 6 are unlocked, and then the back frame tube 3 is adjusted to the desired tilting angle. After adjustment, the locks 6 are locked again. The user may turn the stand means 14 or 15 to the operative position to stop the baby rocking chair from rocking (see FIG. 8). When not in use, the locks 6 are unlocked, and then the back frame tube 3 is turned forwards and then downwards to collapse the baby rocking chair (see FIG. 9).

Referring to FIG. 11, the padded seat 7 is equipped with a safety belt 71 for securing the baby (not shown) in place.

Figure 12:
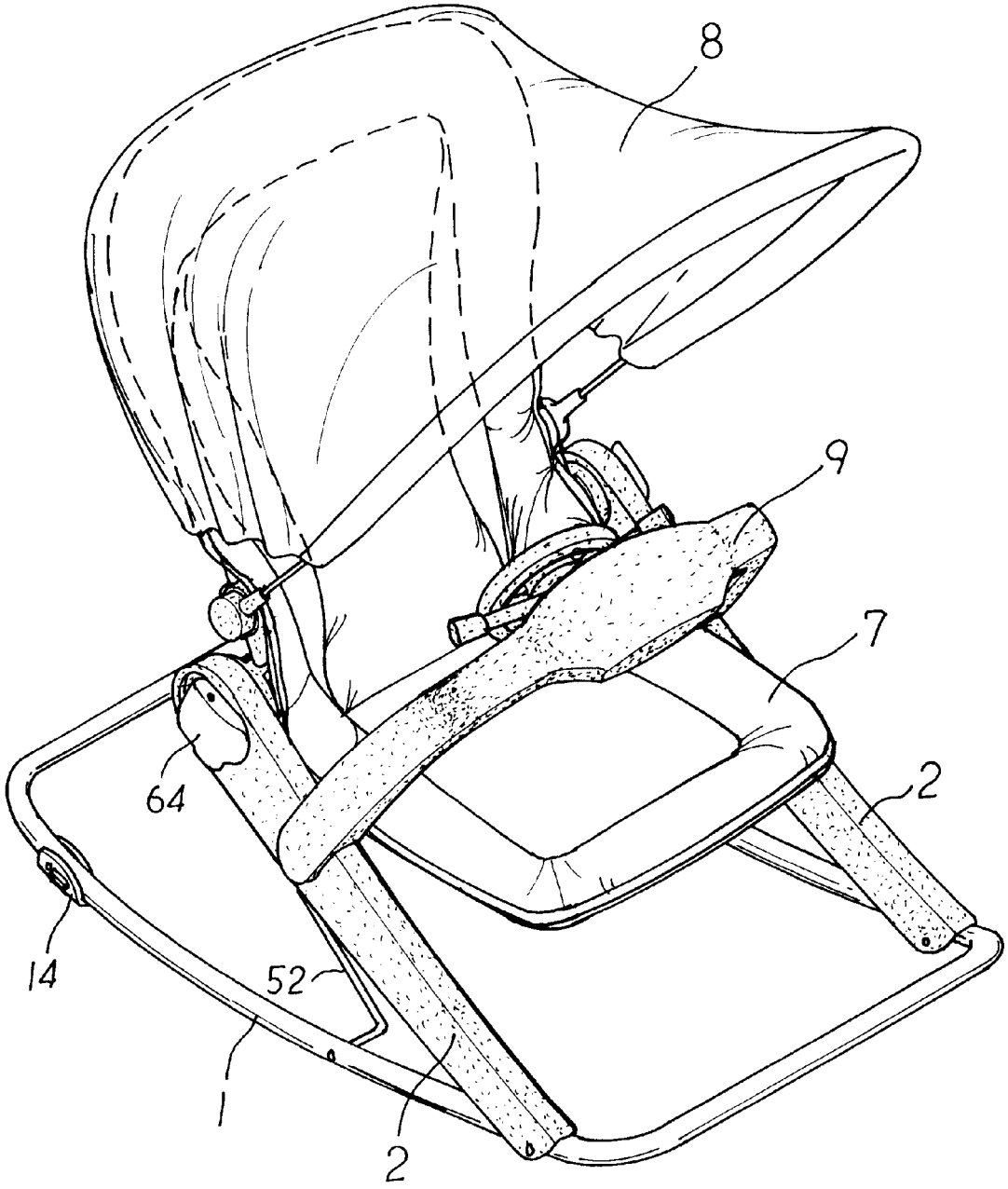
FIG. 12 is a perspective view of another baby rocking chair constructed according to the present invention.

Referring to FIG. 12, the baby rocking chair comprises a canopy 8 mounted on the back frame tube 3, and a toy rack 9 mounted on the sidebars 2.

It is to be understood that the drawings are designed for purposes of illustration only, and are not intended for use as a definition of the limits and scope of the invention disclosed.

What the invention claimed is:

1. A folding collapsible frame structure for a baby rocking chair comprising:

a base frame, said base frame comprising two rockers on two opposing sides of said base frame, two sidebars extending upwardly from said base frame, said sidebars each having a bottom end fixedly connected to one of said rockers of said base frame, a back frame tube, said back frame tube having two distal ends pivotally connected to each top end of said sidebars, a seat frame, said seat frame having two distal ends pivotally connected to said two distal ends of said back frame tube, two front links coupled between said sidebars and said two distal ends of said seat frame, two rear links coupled between said rockers of said base frame and said two distal ends of said back frame tube, and two locks installed in said two distal ends of said back frame tube and said top ends of said sidebars, said locks being locked to stop said back frame tube from being turned relative to said sidebars, and said locks being unlocked to enable said back frame tube to be turned forwardly and downwardly to a collapsed position; wherein said base frame further comprises a transverse front tube connected between said rockers, and two foot rests provided on said rockers.

2. The folding collapsible frame structure of claim 1, wherein:

said frame structure further comprises stand means turned between a first position where said rockers are allowed to rock, and a second position where said stand means stops said rockers from rocking.

3. A folding collapsible frame structure for a baby rocking chair comprising:

a base frame, said base frame comprising two rockers on two opposing sides of said base frame, two sidebars extending upwardly from said base frame, said sidebars each having a bottom end fixedly connected to one of said rockers of said base frame, a back frame tube, said back frame tube having two distal ends pivotally connected to said top end of said sidebars, a seat frame, said seat frame having two distal ends pivotally connected to said two distal ends of said back frame tube, two front links coupled between said sidebars and said two distal ends of said seat frame, two rear links coupled between said rockers of said base frame and said two distal ends of said back frame tube, and two locks installed in said two distal ends of said back frame tube and said top ends of said sidebars; said locks each comprise a first ratchet formed integrally to said top end of one of said sidebars, a casing fastened to one of said ends of said back frame tube, a second ratchet formed integrally to said casing to engage said first ratchet, a headed shaft mounted in a through-hole through said second ratchet and a through hole through said first ratchet, a spring mounted on said headed shaft and connected between said first ratchet and said second ratchet to force said casing with said second ratchet outward from said first ratchet, and a locking lever pivotally connected to one end of said headed shaft; wherein said locking lever is turned between a locking position where said second ratchet is forced into engagement with said first ratchet to stop said back frame tube from movement relative to said sidebars, and an unlocking position where said casing is forced away from said first ratchet for enabling said back frame to be turned with said casing about said headed shaft relative to said sidebars.

* * * * *